US006250059B1

(12) United States Patent
Teich

(10) Patent No.: US 6,250,059 B1
(45) Date of Patent: Jun. 26, 2001

(54) FILAMENT SPOOL OR DOFF HANDLING SYSTEM

(75) Inventor: Udo Teich, Bobingen (DE)

(73) Assignee: Certus Maschinenbau GmbH (DE)

( * ) Notice: Subject to any disclaimer, the term of this patent is extended or adjusted under 35 U.S.C. 154(b) by 0 days.

(21) Appl. No.: 09/284,318

(22) PCT Filed: Nov. 6, 1997

(86) PCT No.: PCT/EP97/06160

§ 371 Date: Apr. 26, 1999

§ 102(e) Date: Apr. 26, 1999

(87) PCT Pub. No.: WO98/24952

PCT Pub. Date: Jun. 11, 1998

(30) Foreign Application Priority Data

Dec. 2, 1996 (DE) ..... 296 20 792

(51) Int. Cl.[7] ..... D01H 13/26

(52) U.S. Cl. ..... 57/281; 53/116; 53/168; 53/430; 57/90; 57/266; 57/267; 57/268; 57/276; 242/35.5

(58) Field of Search ..... 57/90, 266, 267, 57/268, 276; 242/35.5; 53/116, 168, 430

(56) References Cited

U.S. PATENT DOCUMENTS 4,735,040 * 4/1988 Pircher ..... 57/266
5,129,206 * 7/1992 Kidani et al. ..... 53/116
5,292,081 * 3/1994 Langen et al. ..... 242/35.5

FOREIGN PATENT DOCUMENTS 41 17 452 A1 12/1991 (DE) .
42 30 271 A1 3/1993 (DE) .
43 03 416 C2 8/1996 (DE) .
0 478 164 A1 4/1992 (EP) .
0 531 910 A1 3/1993 (EP) .
0 544 976 A2 6/1993 (EP) .

OTHER PUBLICATIONS

Dr. J. Rosenberg Nov. 1992 Automatisiertes Handling von Filamentgarnsplen Chemiefasern/Testilindustrie.
Innovatex Nov. 1987 Canny Four Company Prospectus.
Promoli et al. May 19–20, 1992 Transport und Handhabung in der Textilindustrie Denkendorfer Kolloquiums.

* cited by examiner

*Primary Examiner*—John J. Calvert
*Assistant Examiner*—Shaun R Hurley
(74) *Attorney, Agent, or Firm*—McGlew and Tuttel, P.C.

(57) ABSTRACT

A handling system 1 for filament bobbins 4 or doffs 5 in a spinning mill, which has a spinning area 2 and a storage area 12. The handling system 1 has a transport device 16, a separating device 17 and a transfer station 11. The transport device 6 and the transfer station 11 have multi-column supports 7 for a plurality of doffs 5. The transfer station 11 is arranged between the transport device 6 and the separating device 17 and is located at the edge of or outside the spinning area 2. The separating device 17 is arranged in or at the storage area 12. As a result, the separation of the filament bobbins 4 is performed outside the spinning area 2.

17 Claims, 4 Drawing Sheets

FILAMENT SPOOL OR DOFF HANDLING SYSTEM

FIELD OF THE INVENTION

The present invention pertains to a handling system for filament bobbins or doffs in a spinning mill with a spinning area and a storage area, wherein the handling system connects the spinning area to the storage area and has a transport means for handling and transporting the doffs as well as a separating device for the filament bobbins.

BACKGROUND OF THE INVENTION

Such a handling system has been known from practice. It connects the spinning area with the storage area and has a transport means with a separating device in the spinning area. The transport means comprises a plurality of individual systems, namely, so-called doffers and an overhead monorail conveyor. The doffers have a displaceable and rotatable column, which is rail-borne on the floor and in the head area, with an individual pin for taking up a doff comprising a plurality of filament bobbins. The individual doffer can travel to and fro only in the aisle in front of the spinning frames set up in a row and it can transfer the doff to a carrier of the overhead monorail conveyor in the aisle area. This requires a plurality of doffers. During this transfer, which takes place in the spinning area, the filament bobbins are separated by the doffer and are attached to the carrier on the overhead monorail conveyor. The visual inspection of the individual filament bobbins also takes place in the spinning area. The second transport system then delivers the filament bobbins into the bay area, where they are transferred once again to a high-bay warehouse storage and retrieval system and are stored in a suitable manner. The prior-art technique has the drawback of requiring very much time and complicated apparatus and control engineering. The coordination of the two transport systems and the need that a carrier must be made ready in time for the loaded doffer are also problematic. The automation of the handling system is not always ensured as a result.

SUMMARY AND OBJECTS OF THE INVENTION

The primary object of the present invention is to show a better and more efficient handling system for filament bobbins or doffs.

The present invention accomplishes this object by providing a handling system with a spinning area and a storage area separate from the spinning area. A transport means connects the spinning area to the storage area for handling and transporting the doffs. The transport means includes a multi-column support for a plurality of the doffs. A separating device is arranged separately from the transport means for separating filament bobbins. A transfer station is arranged between the transport means and the separating device. The transfer station has a multi-column support for a plurality of the doffs.

The time-consuming separation of the filament bobbins and the visual inspection are moved away from the transport means and the doffer in the handling system according to the present invention. The transport means is relieved as a result. In addition, the transport means has a multi-column support for handling and transporting a plurality of doffs, which can then be transferred completely at once to a transfer station, which is arranged upstream of the separating device and is likewise provided with a multi-column support. The conveying and performance capacity of the transport means increases as a result. In addition, the travel movements of the transport means are reduced despite the increased doff output.

On the whole, the handling system becomes substantially more efficient, faster, less expensive and more economical. In addition, the transfer operations for the filament bobbins or doffs and optionally also for the empty bobbins become simpler, which requires a less complicated mechanical design. In particular, no overhead transfer is necessary any longer.

The transport means according to the present invention has other advantages as well. It is not necessarily limited to one path of movement any more, but it can move in a substantially larger area and preferably also outside the spinning area. In particular, the individual transport means may also handle a plurality of rows of spinning frames. This also makes it possible to make do with fewer apparatuses in conjunction with the increased take-up and transport capacity. In addition, the transport means may be connected to the areas of the spinning mill, e.g., a crimping device or the like.

The transport means may have any desired design. In the preferred embodiment, it is one or more floor-bound vehicles with inductive guidance and remote control or an overhead conveyor. The handling system according to the present invention makes do with one transport system and no longer needs the bipartition into frame-bound doffer and overhead monorail conveyor. The design effort is substantially reduced as a result. The transport means according to the present invention can perform all conveying operations up to the transfer station, which saves time and money.

The shifting of the time-consuming separation of the filament bobbins of the doff from the spinning area into the storage area is of particular advantage. More time and more place are usually available there. In addition, the visual inspection can be better accommodated here and can even be shifted to an area just in front of the storage of the filament bobbins. As a result, all the effects of errors that may occur up to the storage can be taken into account and corrected if necessary.

The transfer station preferably forms the interface between the spinning area and the storage area. It makes it possible, in particular, to accommodate these two areas separated in space, e.g., on different floors of a mill. The transfer device with a conveying means of its own may optionally also be equipped with one or more storage places for this purpose. It may also act as a buffer between the spinning area and the storage area. For mechanical engineering and capacity reasons, it is useful to integrate the separating device within the transfer station.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
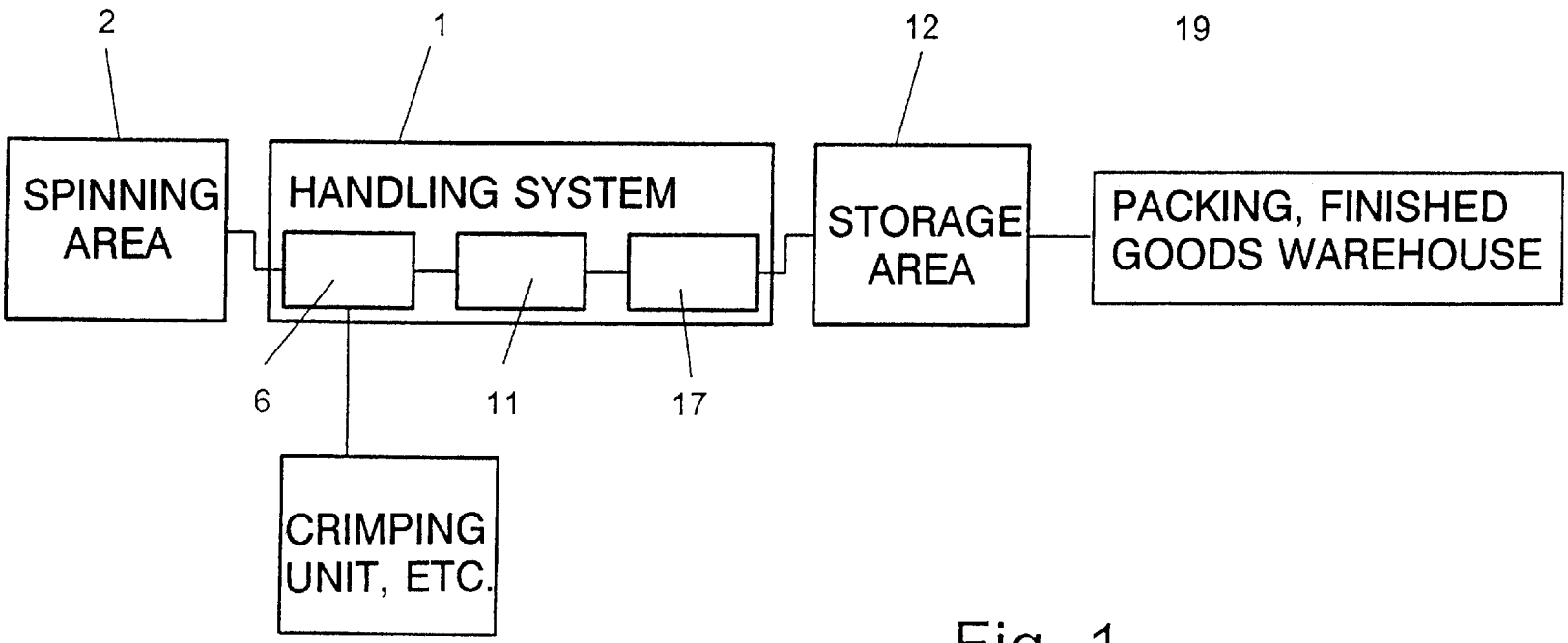
FIG. 1 is a schematic design of a spinning mill.
Figure 2:
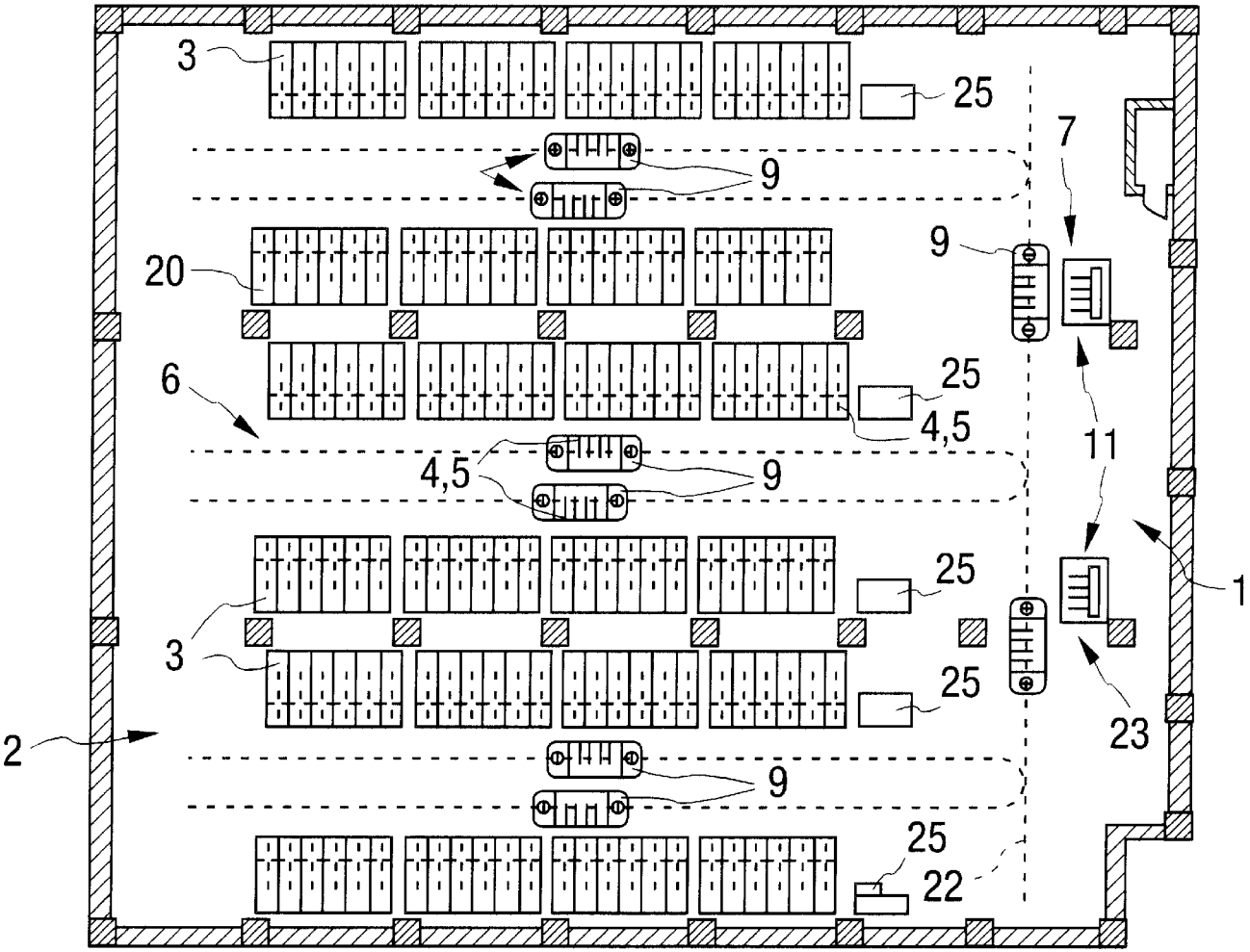
FIG. 2 is a top view of a spinning area with part of the handling system.
Figure 3:
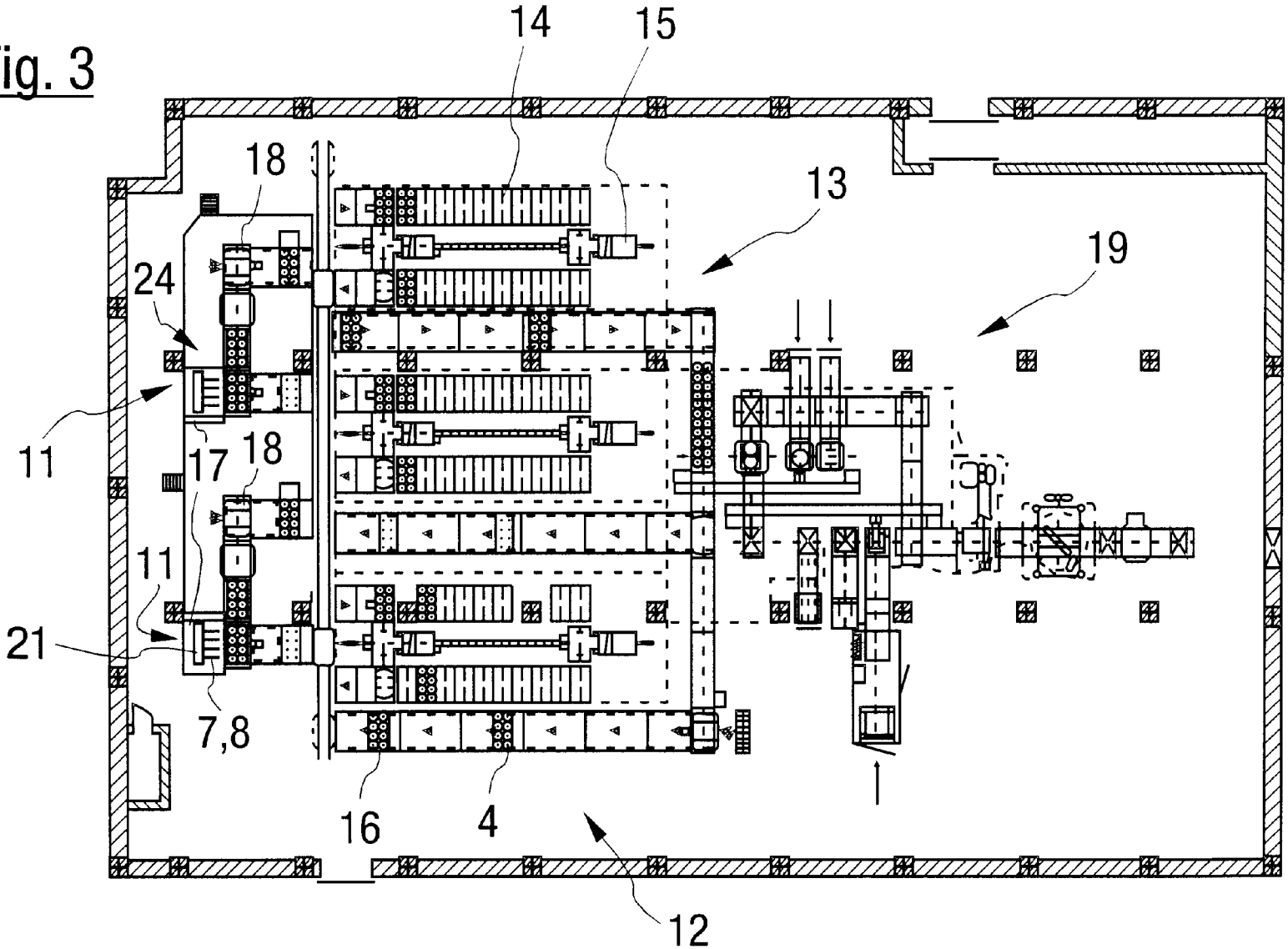
FIG. 3 is a top view of the storage area with part of the handling system.

Referring to the drawings, FIGS. 1, 2 and 3 show top views of a spinning mill with a production area or spinning area 2 and a storage area or a bobbin warehouse 12, which are connected to one another via a handling system 1. The storage area 12 may be an intermediate storage area, which is joined by a packing area 19, a finished goods warehouse not shown, or the like. The different areas 2, 12, 19 may be separated in space and may be arranged, in particular, on different floors.

A plurality of spinning frames or bobbin frames 3, which are arranged in a plurality of rows, are located in the spinning area 2, and aisles for a transport means 6, which will be described in greater detail below, are left free between the rows of frames. The spinning frames 3 wind and produce filament bobbins 4, which are placed on pins 8 in groups of several such filament bobbins and form a so-called doff 5. The filament bobbins 4 comprise, e.g., a tubular bobbin carrier or a bobbin case 26, on which the filament is wound to form a bobbin. The bobbin case 26 preferably projects on both sides over the filament. The empty cases 26 may be stocked in a case storage unit 25 at the end of the aisles.

A plurality of doffs 5 are produced simultaneously on the spinning frame 3. However, the doffs 5 are ready at different points in time. The spinning frames 3 preferably have transfer means 20 for transferring the doffs 5 to the transport means 6.

The storage area 12 is designed as a bobbin warehouse for separated filament bobbins 4, which has one or more storage systems 13. The storage systems 13 may be designed as desired. In the embodiment shown, they comprise one or more bays 14 with corresponding high-bay warehouse storage and retrieval systems 15 and optionally additional conveying means and devices, e.g., roller tables, input and output stations, transferring units, turning means, pushover units, etc. In the preferred embodiment, the filament bobbins 4 are held individually on so-called shelves 16 or pallets and are stored with these in the bays 14. The shelves 16 carry a plurality of filament bobbins, e.g., in an 8-pack. The bays 14 may be, e.g., high bays with a plurality of storage places.

On the output side, the storage area 12 may be joined by the packing area 19, which is operated by means of a suitable material handling equipment. The filament bobbins 4 are packed in foils and/or boxes or in any other suitable manner there and are made ready for shipping. The packing area 19 may have any desired suitable design. As an alternative, it may also be eliminated.

The handling system 1 connects the spinning area 2 with the storage area 12. It is preferably controlled fully automatically and is integrated within or connected to a higher-level process control of the mill.

The handling system 1 comprises at least one transport means 6, one or more transfer stations 11 and one or more separating devices 17. The one or more transport means 6 is/are arranged separated from the separating device or separating devices 17. The transfer stations 11 are arranged between the one or more transport means 6 and the separating device or separating devices 17.

Figure 4:
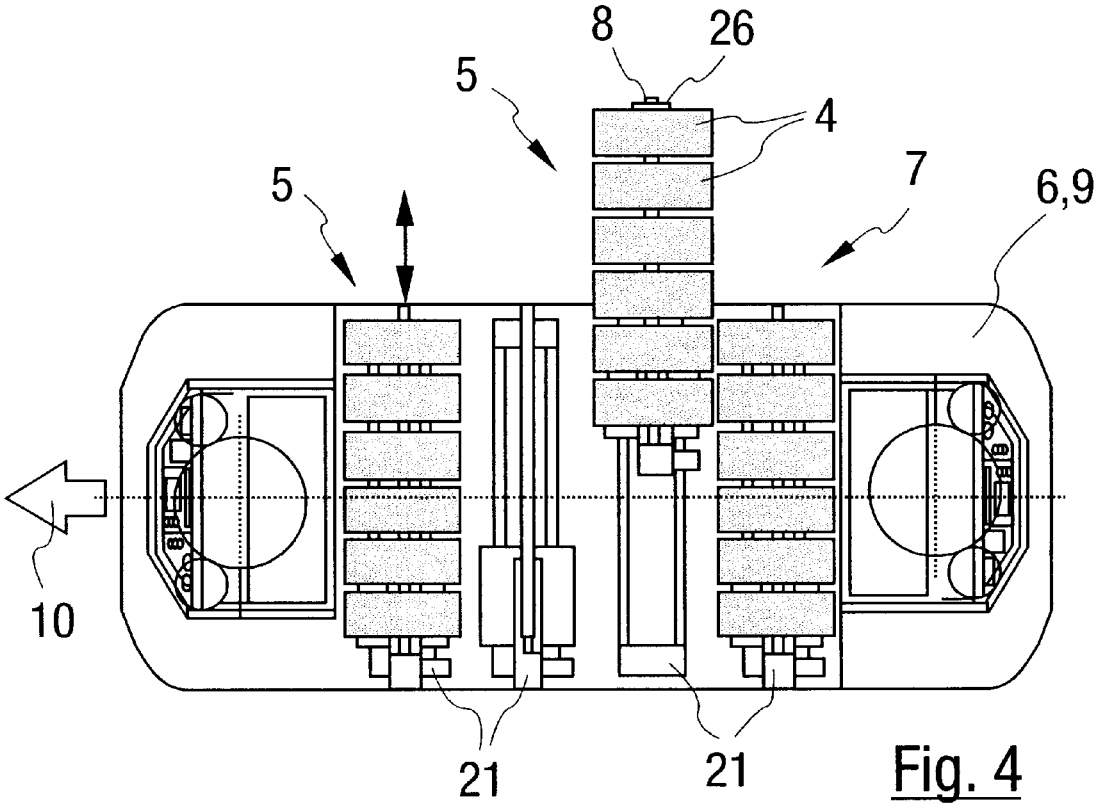
FIG. 4 is an enlarged top view of a transport means.

As is illustrated in FIGS. 2 and 4, the transport means 6 comprises one or more conveying means 9, which are able to travel at least along the rows 3 of spinning frames. The handling system 1 preferably has only one type of transport means 6, with which all tasks that need to be performed in terms of the handling and transport of the filament bobbins 4 or doffs 5 are performed. A multiple arrangement of different transport systems, as in the state of the art, in which transfer operations also take place between the transport systems, is preferably avoided. The transport means 6 preferably also comprises only one type of conveying means 9.

In the preferred embodiment, the conveying means 9 are designed as floor-bound and preferably inductively guided, remote-controllable vehicles. However, as an alternative, the conveying means 9 may also be designed in any other, suitable manner, e.g., as overhead conveyors, especially an overhead monorail conveyor or the like.

The transport means 6 is arranged at least in the area of the spinning frames 3 and preferably extends beyond this spinning area 2. The range of movement of the transport means 6 may extend into the proximity of the storage area 12 or even into other areas of the spinning mill.

The transfer stations 11 are arranged at the edge of or outside the spinning area 2 and are located in the range of movement of the transport means 6.

The transport means 6 or the conveying means 9 and the transfer stations 11 have multi-column supports 7 for picking up and transporting a plurality of doffs 5. The supports 7 comprise a plurality of pins 8, which are arranged next to one another in a row and are aligned at right angles to the direction of travel 10 of the transport means 6 and are flush with the pins 8 of the spinning frames 3 in the transfer position in front of the spinning frames 3. The supports 7 may act on one side, as is shown in FIGS. 2 and 4. However, as an alternative, they may also act on both sides and be mounted, e.g., rotatably on the conveying means 9 for this purpose. Conveying means 9 operating on both sides permit a single-track operation and narrower aisles, which makes possible a better utilization of the space in the spinning area.

The pins 8 are preferably arranged in one layer and at the level of the spinning frame pins 8 at the transport means 6 and the transfer stations 11. As an alternative, the transport means 6 and/or the transfer stations 11 may also have a plurality of layers of pins 8 one on top of another, which can be adjusted in height and can be brought into transfer position with the spinning frame 3 by means of a suitable means. The pins 8 at the transport means 6 preferably retain their alignment at right angles to the path of movement 10 in both embodiments.

The supports 7 of the transport means 6 and of the conveying means 9 and of the transfer stations 11 preferably have the same design. In the exemplary embodiment shown, the supports 7 have four or six pins 8 arranged next to each other. The arrangement and the distribution may also be aligned with and adjusted to the pin arrangement at the spinning frame 3, but it does not have to be.

According to FIG. 2, the conveying means 9 may move in one or two tracks along the spinning frame rows 3, turn at the end of the aisle and move to the opposite spinning frame row 3 or move over an outer transverse line 22 to the next but one spinning frame row or to any other spinning frame row. As a result, the conveying means 9 can be moved in the spinning area 2 as desired. The transfer stations 11 are also located at the transverse line 22. There are two transfer stations 11 in the exemplary embodiment shown.

The transport means 6 and the conveying means 9 have at least one doffer function and one transport function, i.e., they take over the finished doffs 5 from the spinning or bobbin frame 3 and bring them to the transfer stations 11. A donner function may also be additionally present, i.e., the transport means 6 and the conveying means 9 place empty cases 26 from the case storage area 25 on the spinning or bobbin frame 3 after the removal of the full doffs 5.

The transport means 6 and the conveying means 9 are gradually loaded by the spinning frames 3 with doffs 5. The conveying means 9 can now move to and fro between different spinning frames 3. The loading is carried out by means of transfer means 20 at the spinning frames 3. As an alternative, the transfer means 20 may also be arranged at the conveying means 9.

As soon as one conveying means 9 has been sufficiently loaded, it moves out of the spinning area 2 to an area in front of the next transfer station 11 and releases all doffs 5 to this preferably all at once. The conveying means 9 has a suitable unloading device 21 for this purpose, which may be designed, e.g., as a pusher or as a conveying spindle or as any other suitable means. FIG. 4 shows this design. It also shows that a doff 5 consists, e.g., of six filament bobbins 4, which are attached one behind the other at spaced locations.

The transfer station 11 may have various designs. In the exemplary embodiment shown, it has a receiving area 23, which faces the spinning area 2 and at which the pins, 8 are aligned with the transport means 6. The transfer station 11 also has a release area 24, which faces the storage area 12. A conveying means, e.g., an elevator or the like, may be arranged between the input and release areas 23, 24. Furthermore, one or more turning devices may be present to rotate the pins 8 with the doffs 5. This is advantageous, e.g., for positioning the filament bobbins 4 in the desired alignment with the shelf 16 and to place the thread remnant upward or downward. In addition, the transfer stations 11 may also have intermediate storage places. These components of the transfer stations 11 are not shown for clarity's sake.

The transfer stations 11 form the interface between the spinning area 2 and the storage area 12. On the storage area side, they are connected to at least one separating device 17, which is preferably integrated within the transfer station 11. The separating device 17 may have any desired, suitable design. It may be, e.g., a gripping robot or another similar, suitable device, which removes the filament bobbins 4 from the transfer station 11 one by one and places them on the shelf 16 or another suitable storage means for the warehouse system 13. The separating device 17 preferably operates such that it arranges all filament bobbins 4 of one doff 5 on one shelf 16 and avoids the mixing of different doffs 5.

One or more checking places 18, at which an automatic and/or visual inspection of the filament bobbins 4, preferably located on the shelves 16, is performed, are located in the storage area 12. For example, a visual inspection of the quality of the filament bobbins, weighing and labeling of the bobbins, tying or pulling off and knotting of the thread remnants or other operations may be performed there. The checking places 18 are preferably located between the separating device 17 and the bays 14.

Various modifications of the embodiment shown are possible. For example, the spinning and storage areas 2, 12 may be brought closer to one another and may optionally also be directly connected to one another. In addition, the transport means; 6 may be expanded and service, e.g., other areas of the spinning mill, e.g., a crimping, unit not shown or other treatment means for the filaments or filament bobbins 4. This makes possible a uniform and combined conveying system, which permits all production areas to be connected to the storage area 12 via the transfer stations 11. Variations are also possible in terms of the frame components used.

In another variant, the separation of the filament bobbins 4 may be carried out in the separating device 17 on so-called monotrays instead of on shelves 16. The monotrays carry one bobbin 4 only and can be moved one by one. Sorting according to grades, types of filament, colors and other desired criteria may be performed with the monotrays before storage of the filament bobbins 4. The filament bobbins 4 separated onto the monotrays can then be collected separately according to type in an intermediate storage area and be sent to the finished goods warehouse only from there. Before they are brought into the finished goods warehouse, they may again be transferred onto shelves 16.

While specific embodiments of the invention have been shown and described in detail to illustrate the application of the principles of the invention, it will be understood that the invention may be embodied otherwise without departing from such principles.

LIST OF REFERENCE NUMBERS

1 Handling system
2 Production area, spinning area
3 Spinning frame
4 Filament bobbin
5 Doff
6 Transport means
7 Support
8 Pin
9 Conveying means, vehicle
10 Travel path, direction of travel
11 Transfer station
12 Storage area, bobbin warehouse
13 Warehouse system
14 Bay
15 Bay storage and retrieval means
16 Shelf, pallet
17 Separating device
18 Checking area, visual inspection
19 Packing area
20 Transfer means
21 Release device
22 Transverse line
23 Receiving area
24 Release area
25 Case storage area
26 Bobbin case, empty case

What is claimed is:

1. A handling system for a plurality of doffs and filament bobbins in a spinning mill, the system comprising:

a spinning area including a plurality of spinning frames, each of said spinning frames winding a plurality of filament bobbins in a row behind each other to form a doff;

a storage area separate from said spinning area;

transport means connecting said spinning area to said storage area and for handling and transporting the doffs, said transport means includes a multi-column support for directly receiving a plurality of the doffs from said spinning frames;

a separating device arranged separately from said transport means and for separating the filament bobbins of the doffs;

a transfer station arranged between said transport means and said separating device, said transfer station having a multi-column support for holding a plurality of the doffs for separating by said separating device.

2. The system in accordance with claim 1, wherein:

said transport means and said transfer station include a plurality of said multi-column supports.

3. The system in accordance with claim 1, wherein:

said transfer station is arranged outside of said spinning area.

4. The system in accordance with claim 1, wherein:

said separating device is arranged adjacent to said storage area.

5. The system in accordance with claim 1, wherein:

said transport means is arranged in and outside said spinning area.

6. The system in accordance with claim 1, wherein:

said plurality of spinning frames simultaneously spin a plurality of said filament bobbins on one of said doffs;

said transport means has a conveying means for moving along said spinning frames and directly receiving complete doffs with the plurality of the filament bobbins in a row from said spinning frame, said conveying means includes a plurality of pins for the doffs, said pins are directed at substantially right angles to a direction of travel of said conveying means, said conveying means discharging the complete doffs directly to said transfer station.

7. The system in accordance with claim 6, wherein:

said transport means includes a plurality of said conveying means, and said conveying means are designed as floor-bound and inductively guided vehicles.

8. The system in accordance with claim 6, wherein:

said conveying means is designed as an overhead conveyor.

9. The system in accordance with claim 1, wherein:

a checking place is arranged in an area of said separating device for one of automatic and visual inspection of the filament bobbins.

10. The system in accordance with claim 1, wherein:

said transfer station has a conveying means and a storage place.

11. The system in accordance with claim 1, wherein:

said separating device is integrated within said transfer station.

12. The system in accordance with claim 1, wherein:

said transfer station is arranged at an edge of said spinning area.

13. The system in accordance with claim 1, wherein:

said separating device is arranged in said storage area.

14. A handling system for a plurality of doffs and filament bobbins in a spinning mill, the system comprising:

a spinning area including a plurality of spinning frames, each of said spinning frames winding a plurality of bobbins to form a doff;

a storage area separate from said spinning area;

transport means for directly receiving doffs with a plurality of the bobbins from said spinning frames, said transport means simultaneously moving a plurality of the doffs away from said spinning frames;

a separating device arranged separately from said transport means and for individually separating the plurality of bobbins on the doffs;

a transfer station arranged between said transport means and said separating device, said transfer station directly receiving the plurality of doffs from said transport means and holding the plurality of the doff for said separating device.

15. The system in accordance with claim 14, wherein:

said transport means includes a carriage for directly receiving the doffs with a plurality of the bobbins from said spinning frames, said carriage transporting the doffs directly to said transfer station.

16. The system in accordance with claim 14, wherein:

said spinning frames simultaneously wind a plurality of the bobbins on a single doff.

17. The system in accordance with claim 16, wherein:

said doffs produced by said spinning frames include a plurality of said bobbins arranged in a row one behind the other;

said transport means includes a plurality of said carriages and said carriages are floor bound, said carriages take over complete doffs in a row from said spinning frames and discharge the complete doffs to said transfer station.

* * * * *